US009286798B2

(12) United States Patent
Kim

(10) Patent No.: US 9,286,798 B2
(45) Date of Patent: Mar. 15, 2016

(54) SPEEDING ENFORCEMENT METHOD OF VEHICLE USING WIRELESS COMMUNICATIONS

(71) Applicant: MANDO CORPORATION, Pyeongtaek-si, Gyeonggi-do (KR)

(72) Inventor: Jee Hoon Kim, Yongin-si (KR)

(73) Assignee: MANDO CORPORATION, Pyeongtaek-Si, Gyeonggi-Do (KR)

( * ) Notice: Subject to any disclaimer, the term of this patent is extended or adjusted under 35 U.S.C. 154(b) by 31 days.

(21) Appl. No.: 14/252,904

(22) Filed: Apr. 15, 2014

(65) Prior Publication Data

US 2015/0161888 A1 Jun. 11, 2015

(30) Foreign Application Priority Data

Apr. 19, 2013 (KR) ..... 10-2013-0043269

(51) Int. Cl.
*G08G 1/01* (2006.01)
*G08G 1/052* (2006.01)

(52) U.S. Cl.
CPC ..... *G08G 1/052* (2013.01)

(58) Field of Classification Search
CPC . G08G 1/054; G08G 1/052; G08G 1/096716; G08G 1/09675; G08G 1/0175; G08G 1/09626; G08G 1/096775; G08G 1/096783; G08G 1/20; G01C 11/025; G01C 21/32; G01C 21/26; G01C 7/04; G01P 3/38
USPC ..... 340/936, 441, 466, 905, 539.1, 937, 340/942, 945, 931, 973, 969, 951, 978
See application file for complete search history.

(56) References Cited

U.S. PATENT DOCUMENTS

| | | | | |
|---|---|---|---|---|
| 6,864,784 | B1 * | 3/2005 | Loeb | 340/441 |
| 2004/0101166 | A1 * | 5/2004 | Williams et al. | 382/104 |
| 2009/0195411 | A1 * | 8/2009 | Ichihashi et al. | 340/905 |
| 2012/0287278 | A1 * | 11/2012 | Danis | 348/148 |
| 2013/0325258 | A1 * | 12/2013 | Cooper et al. | 701/36 |

FOREIGN PATENT DOCUMENTS

| | | | |
|---|---|---|---|
| CH | 1020080059518 | * | 6/2010 |
| KR | 1020040106711 | A | 12/2004 |
| KR | 1020080047924 | A | 5/2008 |
| KR | 1020100000138 | A | 1/2010 |
| KR | 1020110096221 | A | 8/2011 |

(Continued)

OTHER PUBLICATIONS

Korean Notice of Allowance for Korean application No. 10-2013-0043269 dated Dec. 23, 2014.

(Continued)

*Primary Examiner* — Daniel Previl
(74) *Attorney, Agent, or Firm* — Hauptman Ham, LLP

(57) ABSTRACT

A vehicle speed enforcement method includes the steps of receiving and collecting, by a base station located in a detection zone, information about a target vehicle from a communication unit in the target vehicle, detecting a speed of the target vehicle through the collected information about the target vehicle, and setting the target vehicle as an overspeed vehicle when the speed of the target vehicle is faster than a reference limit speed at a point in time at which the target vehicle has entered the detection zone.

9 Claims, 5 Drawing Sheets

(56) References Cited

FOREIGN PATENT DOCUMENTS

| | | | |
|---|---|---|---|
| KR | 1020130007157 | A | 1/2013 |
| KR | 101251961 | B1 | 4/2013 |

OTHER PUBLICATIONS

Korean Official Action dated Jul. 22, 2014 of the corresponding Korean Application No. 10-2013-0043269.

* cited by examiner

SPEEDING ENFORCEMENT METHOD OF VEHICLE USING WIRELESS COMMUNICATIONS

BACKGROUND OF THE INVENTION

1. Field of the Invention

The present invention relates to a speed enforcement method of performing speed enforcement by measuring the speed of a vehicle, and more particularly to a speed enforcement method of performing vehicle speed enforcement using wireless communication.

2. Description of Related Art

Recently, various speed enforcement methods have been performed. Methods for more accurate and reasonable overspeed measurement have been constantly devised.

A loop detector, a camera detector, and a radar detector are representative as the most widely used method. The loop detector detects and amplifies a small change amount in inductance generated by a vehicle passing on loop coil sensors to measure the presence and speed of the vehicle by burying and connecting two loop coil sensors per lane on an asphalt road surface. In addition, the camera detector measures and analyzes the traffic volume of vehicles traveling on a road in real time using a video camera or the like. In addition, the radar detector receives a signal reflected from a vehicle using radar and collects the speed and the model of the vehicle, a traffic volume, etc. regardless of weather conditions.

These conventional speed enforcement methods have a disadvantage in that the effect of speed enforcement is substantially small because many drivers usually maintain a legal speed only in a detection zone due to enforcement only in a specific zone and run at a speed exceeding the legal speed in a non-detection zone.

In addition, in this case, there is a problem in that the danger of accident is great because drivers tend to suddenly reduce their vehicle speeds in the non-detection zone.

Also, because a device such as the loop detector used in the speed enforcement method as described above is very expensive, there is a problem in that initial installation cost and maintenance cost are high.

CITATION LIST

Patent Literatures (Patent Literature 1) Korean Patent Application Publication No. 10-2011-0096221

(Patent Literature 2) Korean Patent Application Publication No. 10-2008-0047924

SUMMARY OF THE INVENTION

An object of the present invention is to provide a vehicle speed enforcement method capable of identifying a speed of a vehicle in real time and reducing cost necessary for speed enforcement.

It is to be understood that the technical problems to be solved by the present invention are not limited to the aforementioned problems and other unmentioned technical problems will be apparent to a person of ordinary skill in the art from the following description.

According to the present invention, there is provided a vehicle speed enforcement method including the steps of: receiving and collecting, by a base station located in a detection zone, information about a target vehicle from a communication unit in the target vehicle; detecting a speed of the target vehicle through the collected information about the target vehicle; and setting the target vehicle as an overspeed vehicle when the speed of the target vehicle is faster than a reference limit speed at a point in time at which the target vehicle has entered the detection zone.

In addition, the step of setting the target vehicle as the overspeed vehicle may include capturing an image of the target vehicle using a photo system provided in the detection zone when the target vehicle has entered the detection zone.

In addition, the vehicle speed enforcement method may further include the step of: delivering an overspeed warning to the target vehicle when the speed of the target vehicle is faster than the reference limit speed between the step of detecting the speed of the target vehicle and the step of setting the target vehicle as the overspeed vehicle.

In addition, the step of receiving and collecting the information about the target vehicle may include receiving the information about the target vehicle in an auxiliary base station provided in a structure on a roadside of a non-detection zone and delivering the information to the base station when the target vehicle is outside a communication range of the non-detection zone.

In addition, a plurality of structures are each provided with the auxiliary base station and located at fixed distances in the non-detection zone.

In addition, the step of receiving and collecting the information about the target vehicle may include receiving the information about the target vehicle from a communication unit in a medium vehicle located at a communicable distance from the target vehicle and delivering the information to the base station when the target vehicle is located outside a communication range of a non-detection zone.

In addition, the step of receiving and collecting the information about the target vehicle may include mutually delivering, by a plurality of medium vehicles, the information about the target vehicle in sequence and delivering the information to the base station.

In addition, the vehicle speed enforcement method may further include the step of: storing the information about the target vehicle, after the step of setting the target vehicle as the overspeed vehicle.

In addition, the vehicle speed enforcement method may further include the step of: transmitting the information about the target vehicle to another authority, after the step of setting the target vehicle as the overspeed vehicle.

The vehicle speed enforcement method according to the present invention has an advantage in that the overspeed of a vehicle can also be measured outside a non-detection zone because the speed of the vehicle can be identified in real time.

In addition, there is an advantage in that installation and maintenance costs of a device for use in speed enforcement are low.

In addition, there is an advantage in that information about a vehicle can be received using multi-hop technology even in a location outside a communication range.

The effects of the present invention are not limited to the aforementioned effects. Those of skill in the art to which the present invention pertains will easily understand that various other effects can be obtained from the present invention described below.

DETAILED DESCRIPTION OF THE INVENTION

Hereinafter, a vehicle speed enforcement method according to the present invention will be described in detail with reference to the drawings.

Figure 1:
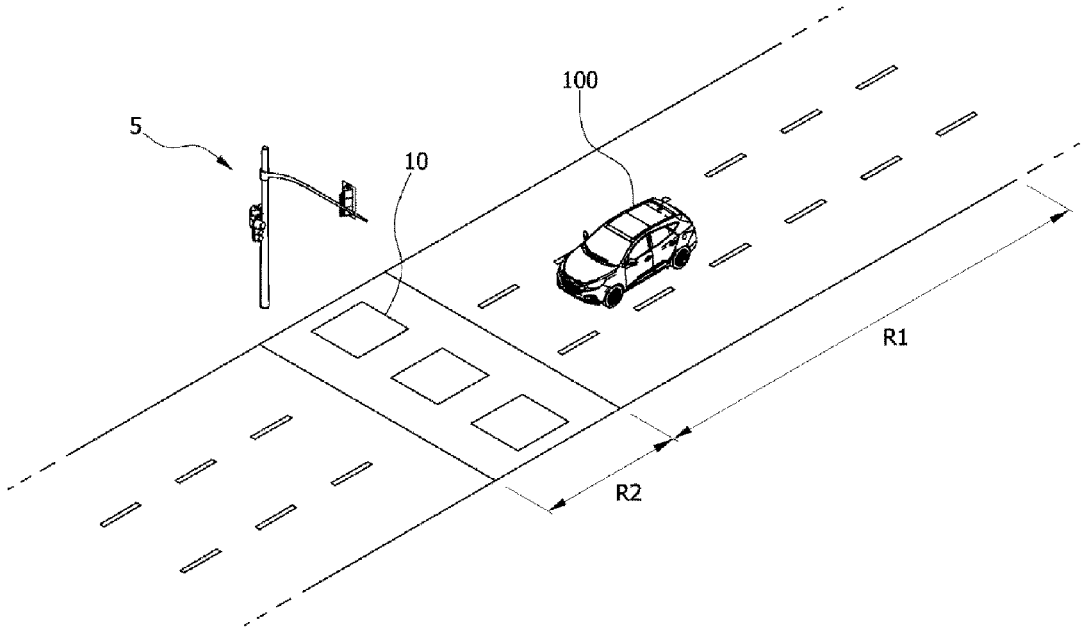
FIG. 1 (PRIOR ART)
FIG. 1 is a diagram illustrating a conventional vehicle speed enforcement method.

FIG. 1 is a diagram illustrating a conventional vehicle speed enforcement method.

In FIG. 1, the most widely used speed enforcement method in the conventional art is illustrated. Referring to FIG. 1, the measurement of a speed is not performed when a vehicle 100 runs in a non-detection zone R1. In addition, when the vehicle 100 passes through a detection zone R2, a loop detector 10 buried under the road identifies a vehicle entrance time point and a vehicle passage time point to measure the speed of the vehicle. At this time, when the speed of the vehicle is higher than the legal speed, a photo system 5 shoots the vehicle.

Figure 2:
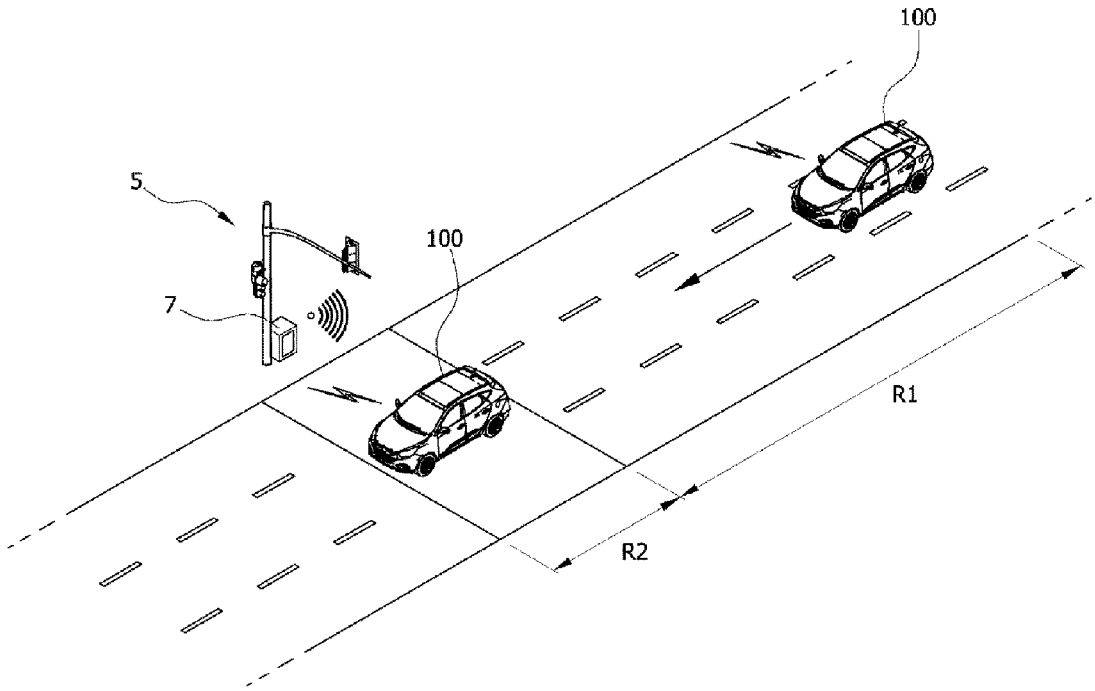
FIG. 2 is a diagram illustrating a state in which a target vehicle runs in a non-detection zone and a detection zone in a vehicle speed enforcement method according to a first exemplary embodiment of the present invention.

FIG. 2 is a diagram illustrating a state in which a target vehicle 100 runs in a non-detection zone R1 and a detection zone R2 in a vehicle speed enforcement method according to a first exemplary embodiment of the present invention.

As a first step for speed enforcement, a base station 7 located in the detection zone R2 receives information about the target vehicle 100 from a communication unit provided in the target vehicle 100 so as to measure the speed of the target vehicle 100.

At this time, information is delivered between the communication unit in the target vehicle 100 and the base station 7 using wireless communication. In the wireless communication, various types of well-known communication methods may be generally used. Because these are well known to those skilled in the art, detailed description is omitted.

In addition, information about the target vehicle 100 may include various information such as vehicle-specific information and global positioning system (GPS) information as well as a speed of a vehicle. Thereafter, the step of detecting the speed of the target vehicle 100 through the received information about the target vehicle 100 is performed.

In this step, the current speed of the target vehicle 100 may be detected through the information about the target vehicle 100. At this time, no follow-up measure is performed when the speed of the target vehicle 100 is less than or equal to a reference limit speed of a road on which the target vehicle 100 is currently running; however, a follow-up measure may be performed when the speed of the target vehicle 100 exceeds the reference limit speed of the road on which the target vehicle 100 is currently running For example, when the speed of the target vehicle is faster than the reference limit speed, the step of delivering an overspeed warning to the target vehicle 100 before the target vehicle 100 enters the detection zone R2 may be further performed. Thus, the driver can recognize an overspeed state of his/her vehicle and reduce the vehicle speed in advance of entering the detection zone.

Thereafter, when the speed of the target vehicle 100 is faster than the reference limit speed at a point in time at which the target vehicle 100 has entered the detection zone R2, the step of setting the target vehicle as an overspeed vehicle is performed.

When the target vehicle 100 reaches the detection zone R2 while the base station 7 collects information about the target vehicle 100 in real time as described above, the speed at an arrival time point may be detected. When the detected speed is faster than the reference limit speed, the target vehicle 100 may be set as an overspeed vehicle.

At this time, in this step, the step of capturing an image of the target vehicle 100 using the photo system 5 provided in the detection zone R2 when the target vehicle 100 enters the detection zone R2 may be additionally performed.

In addition, thereafter, the step of storing the information about the target vehicle 100 set as an overspeed vehicle and the step of transmitting the information to another authority such as a police station, an insurance company, or a traffic control center may be performed.

As described above, the vehicle speed enforcement method of the present invention has an advantage in that it is also possible to measure the presence/absence of overspeed of the vehicle outside a non-detection zone because the speed of the vehicle can be identified in real time based on wireless communication and installation and maintenance costs of a device for use in speed enforcement are low.

Figure 3:
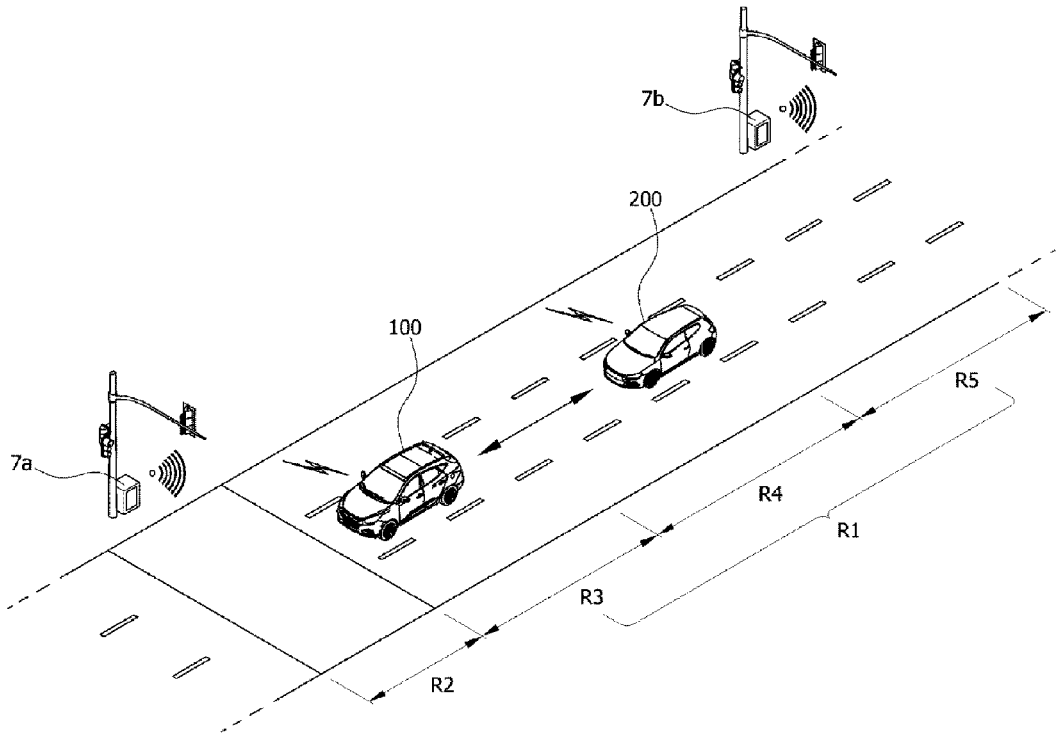
FIG. 3 is a diagram illustrating a state in which information about a target vehicle is received using a communication unit in a medium vehicle when the target vehicle runs at a position outside a communication range of a non-detection zone in the vehicle speed enforcement method according to a second exemplary embodiment of the present invention.

FIG. 3 is a diagram illustrating a state in which information about a target vehicle is received using a communication unit in a medium vehicle when the target vehicle runs at a position outside a communication range of a non-detection zone in the vehicle speed enforcement method according to a second exemplary embodiment of the present invention.

As in FIG. 3, a non-detection zone R1 may include a first non-detection zone R3 within a communication range of a base station 7*a* at which the vehicle will have a later entry time, a third non-detection zone R5 within a communication range of a base station 7*b* through which the vehicle has already passed, and a second non-detection zone R4 outside the communication ranges of the two base stations 7*a* and 7*b* when viewed in the context of overall road length.

Because the first non-detection zone R3 and the third non-detection zone R5 are within the communication ranges of the adjacent base stations 7*a* and 7*b*, respectively, the base stations 7*a* and 7*b* may detect the overspeed vehicle in the corresponding zones.

However, there is a problem in that no side of the base stations 7*a* and 7*b* receives information about the target vehicle 100 when the target vehicle 100 is located in the second non-detection zone R4. Accordingly, in this case, a method in which a communication unit in a medium vehicle 200 located at a distance at which communication with the target vehicle 100 is possible and communicable with at least one base station receives the information about the target vehicle 100 and delivers the information to either the base station 7*a* or 7*b* may be used. In addition, at this time, communication between vehicles may be performed according to a Wireless Access in Vehicle Environment (WAVE) protocol.

Of course, a plurality of medium vehicles 200 are available when the above-described method is used. That is, the plurality of medium vehicles 200 may mutually deliver information about the target vehicle 100 in sequence to deliver the information to the base stations 7*a* and 7*b*.

Figure 4:
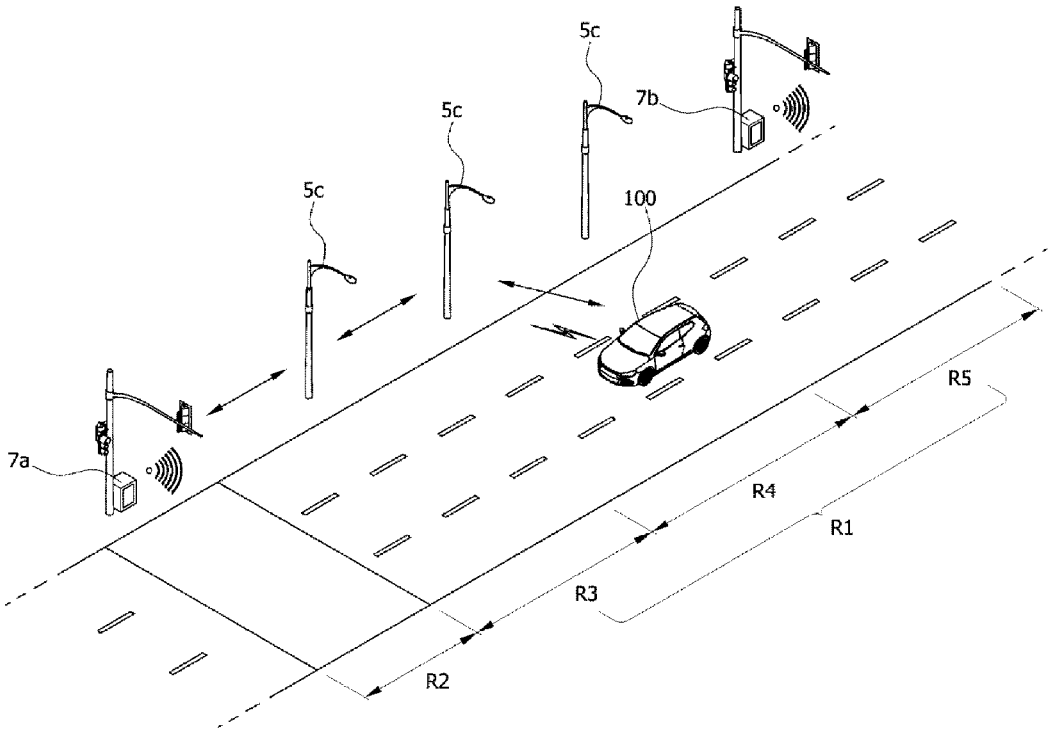
FIG. 4 is a diagram illustrating a state in which information about a target vehicle is received using an auxiliary base station provided in a structure on a roadside when the target vehicle runs at a position outside a communication range of a non-detection zone in a vehicle speed enforcement method according to a third exemplary embodiment of the present invention.

FIG. 4 is a diagram illustrating a state in which information about a target vehicle 100 is received using an auxiliary base station provided in a structure 5*c* of a roadside when the target vehicle 100 runs in a second non-detection zone R4 outside a communication range of a non-detection zone R1 in a vehicle speed enforcement method according to a third exemplary embodiment of the present invention.

As compared to the method of receiving the information about the target vehicle 100 using the medium vehicle 200 in the case of the above-described second exemplary embodiment, a method of receiving information by communicating with the target vehicle 100 to deliver the received information to base stations 7*a* and 7*b* by installing the auxiliary base station in the structure 5*c* on the roadside in advance is used in this exemplary embodiment.

In addition, a wide variety of roadside structures such as a road lamp placed on a roadside or median strip may be used as the structure 5*c*. In addition, a plurality of structures 5*c* may each be provided with the above-described auxiliary base station, and located at fixed distances in the non-detection zone R1. In this case, even when a length of the second non-detection zone R4 in which communication is impossible is long, the information about the target vehicle 100 can be delivered to the base station 7*a* by performing wireless communication between the structures 5*c*.

As described above, in the vehicle speed enforcement method according to the present invention, information may be received using multi-hop technology even when a target vehicle is located outside a communication range.

Figure 5:
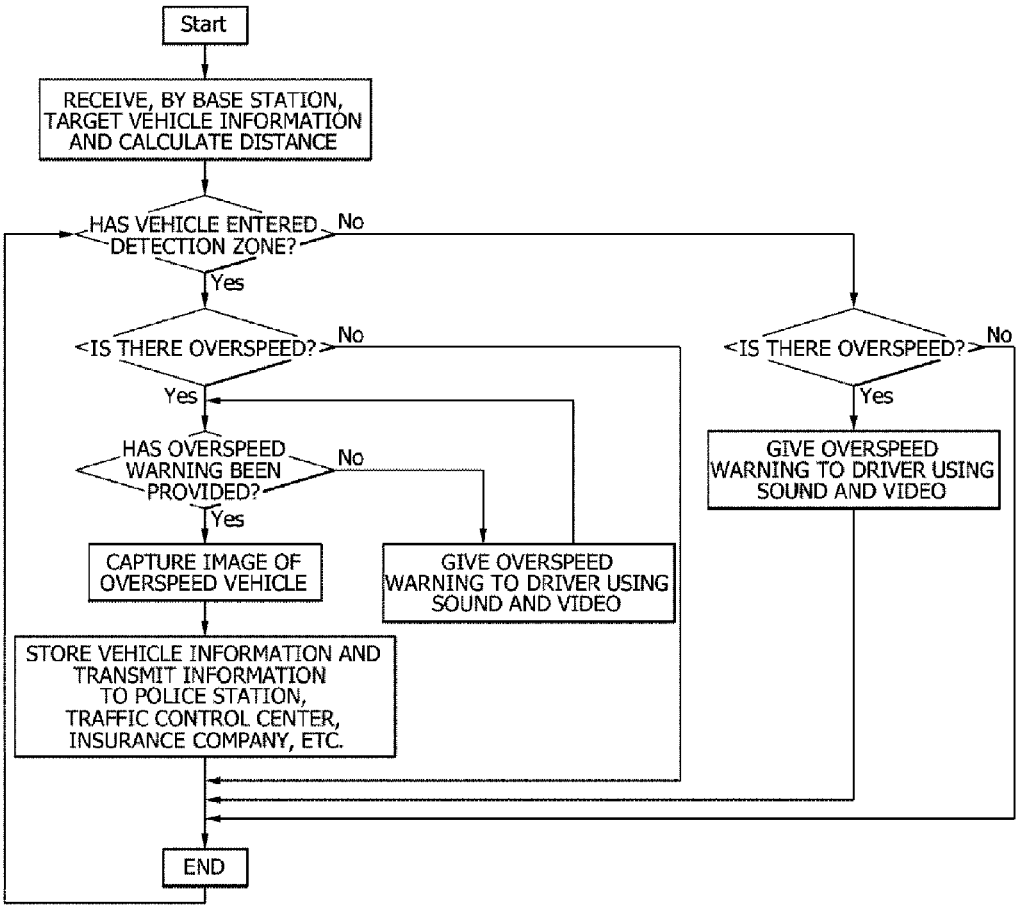
FIG. 5 is a flowchart illustrating a vehicle speed enforcement process in the vehicle speed enforcement method according to the present invention.

FIG. 5 is a flowchart illustrating a vehicle speed enforcement process in the vehicle speed enforcement method according to the present invention. Steps of the above-described vehicle speed enforcement method will be described in sequence with reference to FIG. 5.

First, the base station receives information about a target vehicle and calculates a distance. Accordingly, it is possible to determine a position of the target vehicle. Thereafter, it is determined whether the target vehicle has entered a detection zone.

At this time, because the current time point is not a speed enforcement time point because the target vehicle has not entered the detection zone, it is possible to give an overspeed warning to a driver by a sound, video, or the like when the overspeed occurs by determining the presence/absence of the overspeed.

When the target vehicle has entered the detection zone, the presence/absence of the overspeed is first determined and it is determined whether the overspeed warning has been provided when the overspeed has occurred. When the overspeed warning has not been provided, it is possible to give the overspeed warning to the driver by a sound and video.

When the overspeed warning has already been provided, the step of capturing an image of the overspeed vehicle is performed because the target vehicle has disregarded the overspeed warning and entered the detection zone with an illegal speed.

In addition, the previously received information about the vehicle may be stored and transmitted to another authority such as a police station, a traffic control center, or an insurance company.

Through the above-described process, vehicle speed enforcement is performed.

The embodiments and the accompanied drawings of the present invention have been described for simply describing a part of the technical spirit of the present invention. Accordingly, the embodiments in the present specification have been described for the purpose of the illustration of the technical spirit of the present invention, not for the purpose of the limitation, so that those skilled in the art will appreciate that the scope of the technical spirit of the present invention is not limited by the described embodiments. Further, it shall be construed that all modifications and specific embodiments easily conceivable by those skilled in the art within the scope of the technical spirit included in the specification and drawings of the present invention belong to the scope of the right of the present invention.

What is claimed is:

1. A vehicle speed enforcement method, comprising:

receiving and collecting, by a base station located in a detection zone, information about a first vehicle from a communication unit in the first vehicle;

detecting a speed of the first vehicle through the collected information about the first vehicle; and setting the first vehicle as an overspeed vehicle when the detected speed of the first vehicle is faster than a reference limit speed at a point in time at which the first vehicle has entered the detection zone, wherein, when the first vehicle is located outside a communication range of a non-detection zone, the receiving and collecting comprises:

receiving the information about the first vehicle from a communication unit in a second vehicle located at a communicable distance from the first vehicle; and delivering the information about the first vehicle to the base station.

2. The vehicle speed enforcement method according to claim 1, wherein the setting comprises:

capturing an image of the first vehicle using a photo system located in the detection zone when the first vehicle has entered the detection zone.

3. The vehicle speed enforcement method according to claim 1, between the detecting and the setting, further comprising:

delivering an overspeed warning to the first vehicle when the speed of the first vehicle is faster than the reference limit speed.

4. The vehicle speed enforcement method according to claim 1, wherein the receiving and collecting comprises:

receiving the information about the first vehicle in an auxiliary base station located in a structure on a roadside of a non-detection zone; and delivering the information to the base station when the first vehicle is outside a communication range of the non-detection zone.

5. The vehicle speed enforcement method according to claim 4, wherein the roadside of the non-detection zone comprises a plurality of structures are each provided with the auxiliary base station and located at fixed distances in the non-detection zone.

6. The vehicle speed enforcement method according to claim 1, wherein the receiving and collecting comprises:

mutually delivering, by a plurality of second vehicles, the information about the first vehicle in sequence, to the base station.

7. The vehicle speed enforcement method according to claim 1, further comprising:

storing the information about the target vehicle, after the setting the first vehicle as the overspeed vehicle.

8. The vehicle speed enforcement method according to claim 1, further comprising:

transmitting the information about the first vehicle to another authority, after the setting the first vehicle as the overspeed vehicle.

9. The vehicle speed enforcement method according to claim 1, wherein the receiving and collecting comprises receiving and collecting the information about the first vehicle according to a wireless communication protocol between the first and second vehicles.

* * * * *